US008950222B1

(12) United States Patent
Bonnevie

(10) Patent No.: US 8,950,222 B1
(45) Date of Patent: Feb. 10, 2015

(54) TAMPER RESISTANT PLAQUE HOLDER

(71) Applicant: Bruce A. Bonnevie, Livermore, ME (US)

(72) Inventor: Bruce A. Bonnevie, Livermore, ME (US)

( * ) Notice: Subject to any disclaimer, the term of this patent is extended or adjusted under 35 U.S.C. 154(b) by 0 days.

(21) Appl. No.: 14/154,893

(22) Filed: Jan. 14, 2014

(51) Int. Cl.
*E05B 73/00* (2006.01)
*E04H 13/00* (2006.01)
*E02D 5/80* (2006.01)

(52) U.S. Cl.
CPC ..... *E04H 13/003* (2013.01); *E02D 5/801* (2013.01)
USPC ..... 70/62; 70/58; 70/181; 40/124.5; 40/607.05; 40/607.06; 40/607.07; 52/103; 52/157; 52/4; 135/118

(58) Field of Classification Search
CPC ..... E04H 13/003; E04H 12/2215; E04H 12/2223; E04H 12/2224; E04H 13/2269; E04H 13/00; E04H 13/006; E04H 13/008; E04H 13/001; E04H 12/2269; E04H 15/62; E05B 73/00; E05B 65/00; A45F 3/44
USPC ..... 52/103, 157, 165, 153, 155, 4, 705, 3; 40/124.5, 607.05, 607.6, 607.7; 135/114, 118; 248/551, 553, 500, 506, 248/508, 530, 519; 220/475; 70/58, 59, 62, 70/181, 192, 201, 202, 204, 229
See application file for complete search history.

(56) References Cited

U.S. PATENT DOCUMENTS

| | | | | | |
|---|---|---|---|---|---|
| 87,015 | A | * | 8/1869 | Varian | 52/298 |
| 1,455,882 | A | | 5/1923 | Harding | |
| 2,123,329 | A | * | 7/1938 | Combs et al. | 403/42 |
| 2,229,075 | A | | 1/1941 | Haggart, Jr. | |
| 3,067,846 | A | * | 12/1962 | Luebkeman | 52/157 |
| 3,250,032 | A | * | 5/1966 | Von Gal, Jr. et al. | 40/493 |
| 3,977,110 | A | | 8/1976 | Yerger | |
| 4,320,608 | A | | 3/1982 | Deike | |
| 4,328,687 | A | * | 5/1982 | Ritchie | 70/34 |
| 4,454,824 | A | * | 6/1984 | Wood | 109/52 |
| 4,626,616 | A | * | 12/1986 | Masters | 174/37 |
| 4,664,041 | A | * | 5/1987 | Wood | 109/51 |
| 5,014,472 | A | * | 5/1991 | Svensson | 52/103 |
| 5,094,423 | A | * | 3/1992 | Almquist et al. | 248/552 |
| 5,119,649 | A | * | 6/1992 | Spence | 70/14 |

(Continued)

OTHER PUBLICATIONS

Cam-Lok Removable Bollard—Free Standing Model; printed on Jun. 10, 2011; http://www.coxengineering.com.au/ecms/uploads/94/files/cam-lok_removable_bollards.pdf; Mt Kuring-Gai NSW 2080, Australia.

(Continued)

*Primary Examiner* — Robert Canfield
*Assistant Examiner* — Matthew Gitlin
(74) *Attorney, Agent, or Firm* — Dennis R. Haszko

(57) ABSTRACT

A tamper resistant apparatus for removable retention of a memorial marker such as those found at a grave site. The apparatus includes a locking mechanism housed within a cylinder. The cylinder has a cover intended for use exposed to the environment. The cylinder is attached to a footing plate that provides lateral stability during placement of the apparatus in the ground. Horizontal gripping within the ground is provided by a helical anchor attached to the footing plate. The locking mechanism includes a latch which may be moved into and out of a notch in the post of the memorial marker to respectively retain and release the marker from the apparatus.

20 Claims, 4 Drawing Sheets

(56) References Cited

U.S. PATENT DOCUMENTS

| | | | | |
|---|---|---|---|---|
| 5,199,361 | A * | 4/1993 | Robinson | 109/51 |
| 5,454,178 | A | 10/1995 | Rivard | |
| 5,553,426 | A * | 9/1996 | Ostergaard | 52/103 |
| 5,855,129 | A * | 1/1999 | Warren et al. | 70/234 |
| 6,082,157 | A * | 7/2000 | Boyce | 70/58 |
| 6,406,052 | B1 * | 6/2002 | Bale | 280/507 |
| 6,694,781 | B1 * | 2/2004 | Li | 70/14 |
| 6,953,180 | B1 * | 10/2005 | Ruvalcaba et al. | 248/530 |
| 7,409,915 | B2 * | 8/2008 | Hagar | 109/50 |
| 2010/0154848 | A1 * | 6/2010 | Meibos et al. | 135/16 |
| 2010/0313492 | A1 | 12/2010 | Shellhouse et al. | |
| 2011/0005148 | A1 * | 1/2011 | Foster | 52/157 |
| 2012/0160139 | A1 * | 6/2012 | Pearce | 109/52 |

OTHER PUBLICATIONS

Autopa Removable Parking Post; printed on Jun. 10, 2011; http://www.saundersonsecurity.co.uk/acatalog/Autopa_Removable_Parking_Post_10414.html; London, UK.

Kryptonite Stronghold in Ground, Ground Anchor; printed on Jun. 10, 2011; http://www.locksonline.co.uk/acatalog/ Kryptonitein_Ground_Ground_Anchor_.html; Pembrokeshire, Wales, UK.

Centinel C1 Security Post; printed on Jun. 10, 2011; http://www.centinel.org.uk/security_post_c1.asp; Oldham, Lancashire, UK.

Balch Bros. Flags & More Cemetery Marker; printed on Jun. 10, 2011; http://www.balchflags.com/catalog/cemetery-marker-grave.html; Hastings, NY.

* cited by examiner

TAMPER RESISTANT PLAQUE HOLDER

CROSS REFERENCE TO RELATED APPLICATIONS

None

FIELD OF THE INVENTION

The present invention relates generally to locking mechanisms. More particularly, the present invention relates to locking mechanisms providing tamper resistance and theft protection for post mounted plaques.

BACKGROUND OF THE INVENTION

In the art of memorial markers such as those utilized in grave sites, vandalism and theft are unfortunate occurrences. While grave stones are relatively large and difficult to move, smaller markers tend to be more susceptible to vandalism and theft. In particular, there are certain memorial markers which may have inherent value in terms of the materials from which they are fabricated. One such memorial marker is a metallic medallion. Typically mounted upon a cylindrical metal post, such medallions used in a grave setting commemorate various notable things related to the deceased such as, but not limited to, veteran status, nationality, religious denomination, or the like. Such medallions of course may be used in settings other than a grave setting. One common aspect of any such medallions is their commemorative value or inherent material value in terms of the metal (e.g., bronze, copper, etc.) from which they are fabricated.

One existing post-mounted memorial marker is U.S. Pat. No. 5,454,178 granted to Rivard on Oct. 3, 1995. Rivard provides a medallion for memorializing an individual having a plaque or medallion marker which is serially stackable and rotatably mountable onto a stake, rod or post for insertion into the ground or other base material. A second medallion and subsequently additional medallions may be stackably mounted onto stacking rods. The additional medallions may stackably mount at angles from the vertical direction as measured from the top of the medallion. The medallion/markers may be used typically at grave sites or may be used to identify any region or site. The material is of such composition and finish so as to withstand weathering and to substantially retain the original aesthetic. Rivard further provides a locking mechanism in terms of holes related to a shackle-type of lock to retain the post upon which the medallion(s) are mounted. This type of locking mechanism is highly visible and commonly susceptible to bolt cutters and the like.

It is, therefore, desirable to provide a robust mechanism both tamper resistant, yet easily lockable and unlockable.

SUMMARY OF THE INVENTION

It is an object of the present invention to obviate or mitigate at least one disadvantage of previous known memorial marker retention devices.

In a first aspect, the present invention provides an apparatus providing tamper resistant releasable retention of a memorial marker, the apparatus including: a cover including an aperture located adjacent a center of the cover; a locking mechanism attached to the cover at the center; a footing plate including a recess aligned with the aperture; an elongated anchor connected to the plate; and a canister connecting the cover to the footing plate and providing an inner cavity within which the locking mechanism is moveable between a locked position for retention of the memorial marker and an unlocked position for release of the memorial marker.

In a further aspect, there is provided an apparatus providing tamper resistant releasable retention of a memorial marker, the apparatus including: a cover including an aperture located adjacent a center of the cover, the aperture including a removable plug therein; a footing plate including a recess aligned with the aperture; a locking mechanism attached to the cover at the center, the locking mechanism having a latch capable of movement into a notch of a post attached to the memorial marker so as to retain a portion of the post between the aperture and the recess; a helical anchor connected to the plate; and a canister connecting the cover to the footing plate and providing an inner cavity within which the locking mechanism is moveable between a locked position of the latch within the notch for retention of the memorial marker and an unlocked position of the latch out of the notch for release of the memorial marker.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures.

DETAILED DESCRIPTION

Generally, the present invention provides an apparatus for securely mounting a memorial marker (i.e., plaques) in a substrate such as, but not limited to, earthen ground and including a locking mechanism. Such locking mechanism thus providing tamper resistance and theft protection for post mounted plaques.

Figure 1:
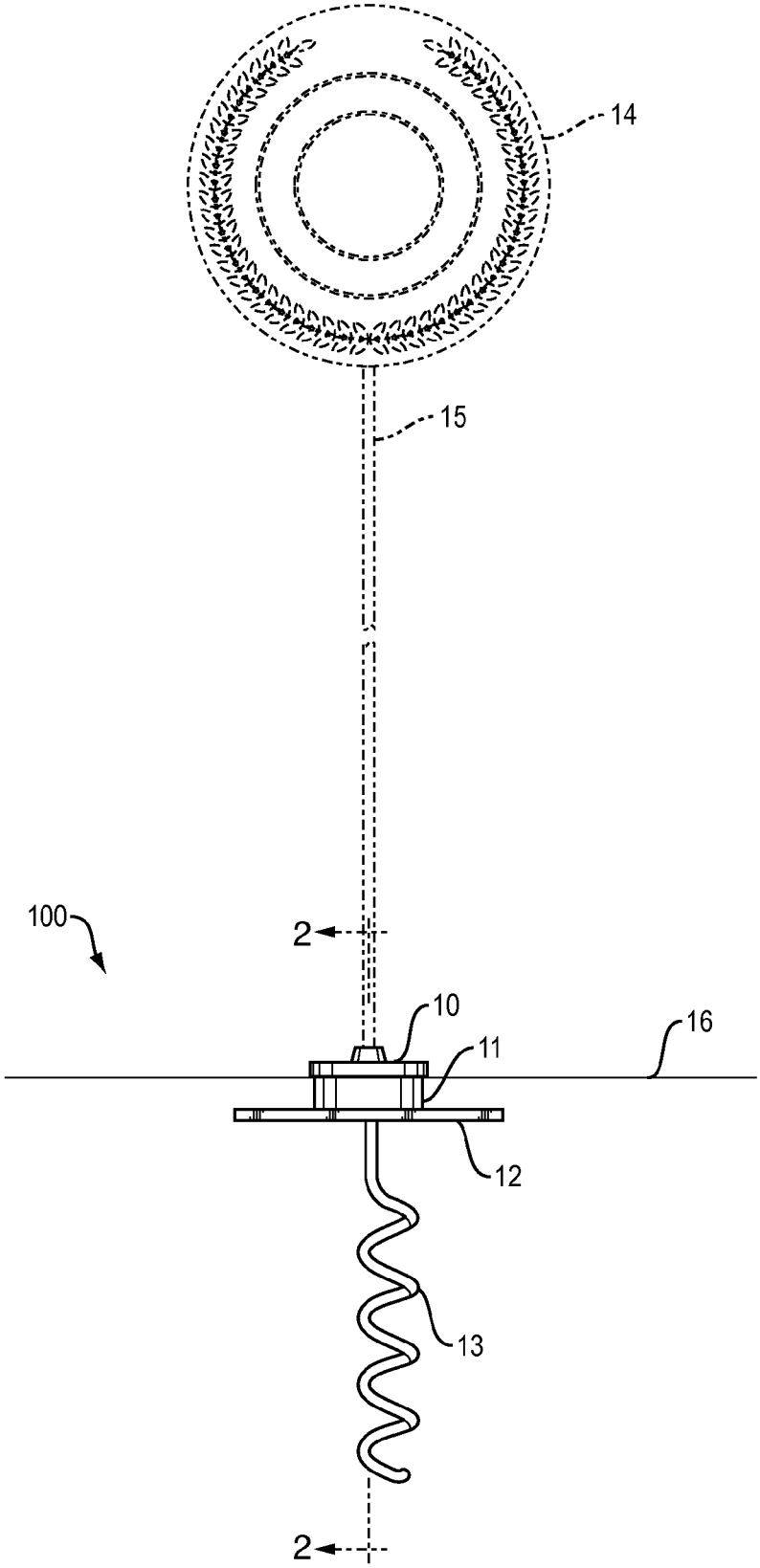
FIG. 1 shows a side view of the present invention in place within the ground with an accompanying memorial marker (shown in silhouette) retained therein.

With specific regard to FIG. 1, the present apparatus 100 includes a cover 10 formed preferably of chemically and sun resistant material, such as but not limited to, nylon or similarly durable polymer material. Although any suitable shape may be provided, the cover 10 is preferably circularly shaped in order to minimize the amount of exposed surface area. Such surface area being the portion of the apparatus 100 which is exposed above the ground surface 16. It should therefore be understood that all remaining elements (11, 12, and 13) of the present invention 100 are placed under the surface of the ground.

With continued regard to FIG. 1, those elements of the apparatus 100 normally situated underground include a helical anchor 13, a footing plate 12, and a canister 11.

The canister 11 may be fabricated from a length of cylinder made of rust-resistant material suitable for ground contact and durable enough to resist frost pressure and incidental impact from being placed out of sight underground. Such expected incidental impact may be from pedestrian or machinery traffic such as, but not limited to, lawn maintenance staff and their vehicles (e.g., mowers). The canister 11 forms the housing for a locking mechanism (shown and described later with regard to FIG. 2).

The cover 10 and topmost edge of the canister 11 are attached together in a suitable manner so as to substantially prevent entry of soil, dirt, or moisture into the inner cavity of the canister 11 where the locking mechanism resides. Though shown simply abutting for the sake of illustrative clarity, it should be understood that the footing plate 12 and bottommost edge of the canister 11 may be attached via screws from the bottom through the footing plate 12 into the canister 11 or any similarly removable manner. This removability facilitates access to the interior of the canister 11 for cleaning or maintenance of components (i.e., locking mechanism) located therein. If cleaning or maintenance is of no concern to manufacture—e.g., if the product embodying the invention is intended for no end-user access—then such connection of the footing plate 12 and canister 11 may of course be made via direct welding or some similarly durable and more permanent manner. The footing plate 12 is preferably fabricated from a material identical to the canister 11 such as, but not limited to, aluminum.

The footing plate 12 is enlarged in its horizontal surface area such that it provides lateral stability to the apparatus 100 when embedded beneath the ground. The footing plate 12 may be of any shape in order to accomplish this function. For ease of manufacture, one such suitable shape is as a square plate. However, alternative shapes may be provided other than a square shape and which may provide improved lateral stability at the expense of increased manufacturing costs. Any such alternative shape being well within the intended scope of the present invention. Likewise, thickness of the footing plate 12 is dictated by a combination of durability requirements, cost of manufacture, and the given material used. For example, a relatively lower thickness may be suitable for a stainless steel footing plate of a larger surface area, though a relatively higher thickness may be required in the same surface area fabricated from aluminum.

The helical anchor 13 is attached to the center of the footing plate 12 by any suitably durable method such as, but not limited to, direct welding or bolting via a through hole in the footing plate 12. Structurally, the helical anchor 13 is formed as an elongated helical auger for screwing the apparatus into the ground. Like the cylinder 11 and footing plate 12, the helical anchor 13 is fabricated from a suitably durable metal that allows a user to rotate the apparatus 100 into a depth of ground. The ground is of course a consideration in terms of the length of the helical anchor 13 and/or the length of the cylinder 11. Possible factors considered in those lengths provided include the size and weight of the post 15 and marker 14 retained by the apparatus 100, the relative hardness of the ground, and the slope of the ground surface. For example, a heavy marker 14 may require increased anchoring of a longer helical anchor 13. Likewise, sandy soil may also require increased anchoring, whereas dense clay may facilitate use of only a relatively short helical anchor 13. Still further, in situations of a sloped ground surface, the cylinder 11 may be lengthened sufficiently so as to ensure the entire footing plate 12 is below ground. In this manner, the given use may dictate the particular manufacturing specifications related to size and/or material used in fabrication. Any such variations being within the intended scope of the present invention.

It should be understood that the accompanying memorial marker 14 and post 15 are shown in silhouette as they may vary greatly in shape, size, and ornamentation. Indeed, the given marker retained within the present invention does not form part of the present invention. However, it should of course be understood that the present invention will require a post 15 of a certain diameter and including a notch corresponding to the latching device in the locking mechanism described further herein below. Any such notch within the post may of course be provided after manufacture of the post/marker.

Figure 2:
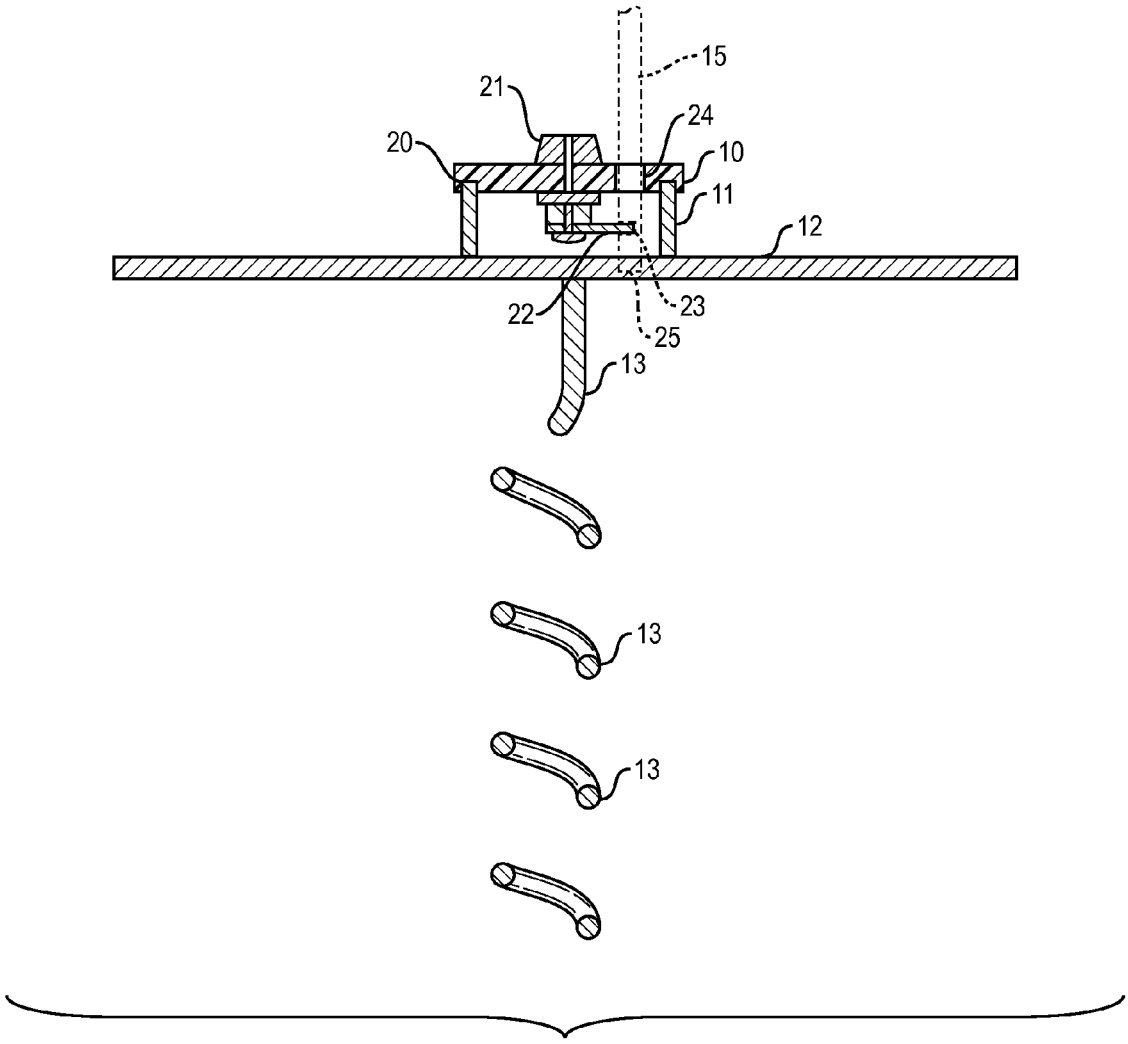
FIG. 2 is a cut-away side view taken along line 2-2 in FIG. 1 and showing the present invention in place within the ground with the bottom post section of an accompanying memorial marker (shown in silhouette) retained therein.

With regard to FIG. 2, the present invention is shown as a cross section taken along line 2-2 as indicated in FIG. 1. Here, the cover 10, footing plate 12, and helical anchor 13 are again seen as before though an inner cavity of the canister 11 is now visible. Within such inner cavity is provided a locking mechanism 21 which actuates a latch 22 into and out of place within a notch 23 of the retained post 15. The locking mechanism 21 may be provided as a common keyed latching device well known within the art of locks. Indeed, one familiar with office furniture drawer locks with a latch that moves in a 90 degree arc when keyed between locked and unlocked positions would readily understand the type of lock used in the present invention. Accordingly, no further description of the lock itself (e.g., internal tumbler, corresponding key, etc.) is deemed necessary herein.

In terms of the position as shown, it should be clear that the latch 22 is shown in the locked position as the latch 22 is situated within the notch 23 of the post 15 thus preventing displacement of the post 15. Torqueing of the post is also prevented by way of a recess 25 in the footing plate 12. The recess 25 is aligned with an aperture 24 in the cover 10 through which the post 15 passes. The aperture 24 is preferably a hole sized only slightly larger than the diameter of the given post 15. In this arrangement, the post 15 is squarely retained within the apparatus. Unlocking, and therefore release of the post 15 from within the apparatus, occurs by movement of the latch 22 from the locked position (as shown) to the unlocked position (not shown) via a key (not shown). Once the latch 22 is removed from the notch 23, it should be readily apparent that the post 15 is free to slide out of the aperture 24 thereby enabling removal of the marker from the ground. This may be advantageously accomplished, for example, prior to winter and accompanying snowfall, perhaps during times of lawn or headstone maintenance, or for replacement or repair of the marker itself.

It should be readily apparent through the description above that the inner workings of the locking mechanism 21 are retained within the cylinder below the level of the ground. This effectively prevents inadvertent damage from occurring to the latch 22 and likewise substantially reduces the opportunity for tampering and/or vandalism. As can be seen in FIG. 2, the cover 10 includes a groove 20 within which the topmost edge of the canister 11 is retained. This aids in reducing tampering because, as previously mentioned, only the top surface of the cover 10 is visible from the ground.

Figure 3:
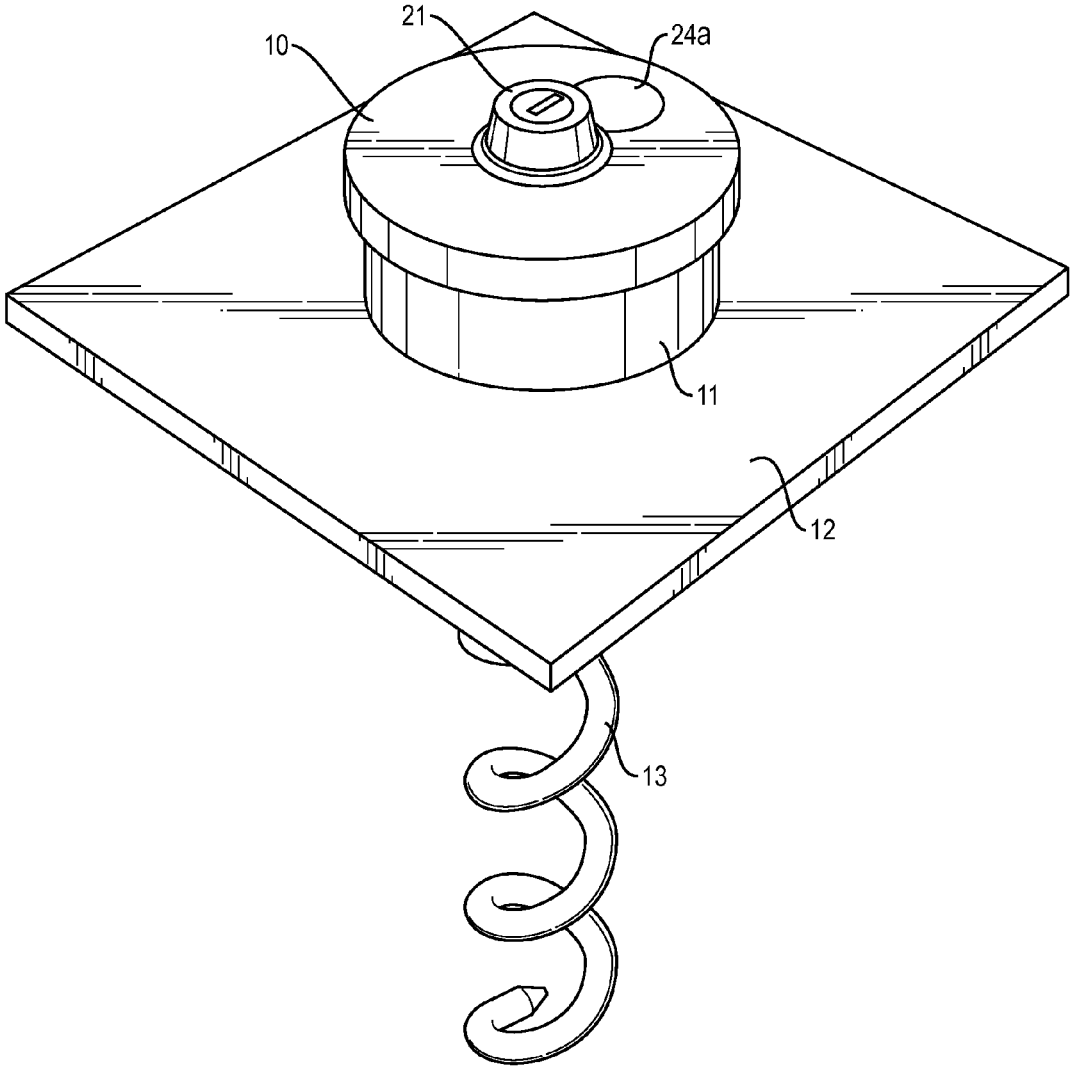
FIG. 3 shows a perspective view from a top of the present invention.
Figure 4:
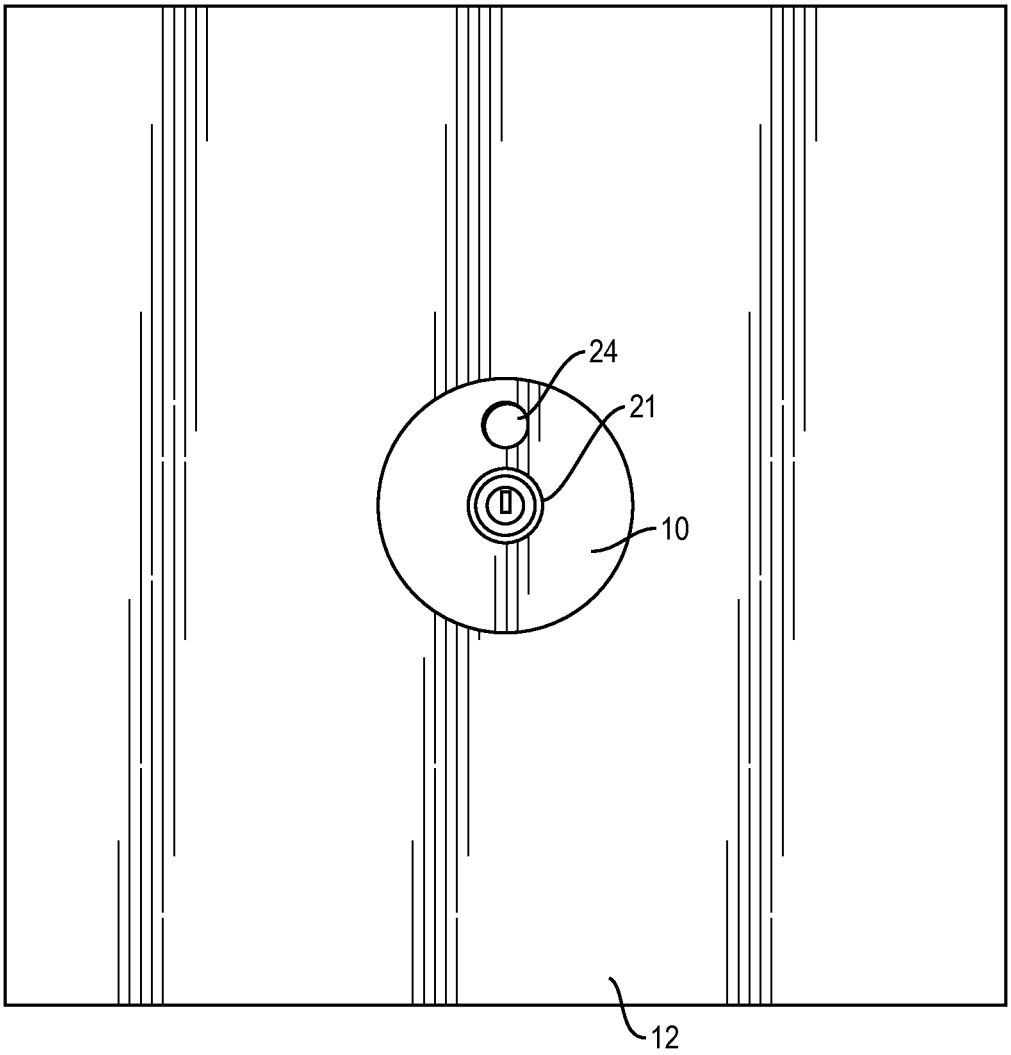
FIG. 4 shows a top view of the present invention.

FIG. 3 shows a perspective view from a top of the present invention. Here, the cover 10, canister 11, footing plate 12, and helical anchor 13 are again shown. The keyhole of the locking mechanism 21 is also clearly discernible from this view. As mentioned before, the post may be removed from the apparatus. Here in FIG. 3, it should be noted that the post is not in place. Rather, a plug **24*a* is shown covering the aperture within the cover where the post would otherwise be situated. Although shown flush with the surface of the cover 10, the plug 24*a* may be slightly raised in a bump-like manner depending upon the plug shape, size, and material used. In general, the plug 24*a* may be of any suitable material (e.g., polymer or rubber) for compression fitting within the hole so as to keep environmental concerns such as moisture or dirt from the inner workings of the locking mechanism when the post is not in place (e.g., during Winter or maintenance as previously mentioned). Similar to FIG. 3, the illustration of FIG. 4 shows a top view of the present invention. Again, the cover 10, canister 11, footing plate 12, helical anchor 13, and locking mechanism 21 are shown. However, here, the plug is removed to reveal the hole 24. This top view also illustrates the preferred ratio of footing plate 12 surface area relative to the exposed (i.e., above ground) portion of the cover 10** area.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An apparatus providing tamper resistant releasable retention of a memorial marker, said apparatus comprising:

a cover including an aperture located adjacent a center of said cover;

a locking mechanism attached to said cover at said center;

a footing plate configured to be buried below a surface of the earth, said footing plate having a width greater than said cover to provide lateral stability, said footing plate including a recessed surface aligned with said aperture, said recessed surface configured to seat an end of a post of said memorial marker to prevent torqueing of said post;

an elongated anchor connected to said plate; and a canister connecting said cover to said footing plate and providing an inner cavity within which said locking mechanism is moveable between a locked position for retention of said memorial marker and an unlocked position for release of said memorial marker.

2. The apparatus as claimed in claim 1, wherein said cover includes a peripheral groove retaining a topmost edge of said canister.

3. The apparatus as claimed in claim 2, wherein said locking mechanism includes a latch capable of movement into a notch of a post attached to said memorial marker so as to retain a portion of said post within said inner cavity between said aperture and said recess.

4. The apparatus as claimed in claim 3, wherein said footing plate has substantially greater horizontal surface area than said cover.

5. The apparatus as claimed in claim 4, wherein said elongated anchor is formed by a helical auger.

6. The apparatus as claimed in claim 5, wherein cover is fabricated from a material resistant to corrosion and sunlight.

7. The apparatus as claimed in claim 6, wherein said footing plate, said canister, and said elongated anchor are each fabricated from a suitably durable metal.

8. The apparatus as claimed in claim 7, wherein cover is fabricated from nylon, said footing plate and said canister are fabricated from aluminum, and said elongated anchor is fabricated from stainless steel.

9. An apparatus providing tamper resistant releasable retention of a memorial marker, said apparatus comprising:

a cover including an aperture located adjacent a center of said cover, said aperture including a removable plug therein;

a footing plate configured to be buried below a surface of the earth, said footing plate having a width greater than said cover to provide lateral stability, said footing plate including a recessed surface aligned with said aperture, said recessed surface configured to seat an end of a post of said memorial marker to prevent torqueing of said post;

a locking mechanism attached to said cover at said center, said locking mechanism having a latch capable of movement into a notch of a post attached to said memorial marker so as to retain a portion of said post between said aperture and said recess;

a helical anchor connected to said plate; and a canister connecting said cover to said footing plate and providing an inner cavity within which said locking mechanism is moveable between a locked position of said latch within said notch for retention of said memorial marker and an unlocked position of said latch out of said notch for release of said memorial marker.

10. The apparatus as claimed in claim 9, wherein said cover includes a peripheral groove retaining a topmost edge of said canister.

11. The apparatus as claimed in claim 10, wherein said footing plate has substantially greater horizontal surface area than said cover.

12. The apparatus as claimed in claim 11, wherein cover is fabricated from a material resistant to corrosion and sunlight.

13. The apparatus as claimed in claim 12, wherein said footing plate, said canister, and said helical anchor are each fabricated from a suitably durable metal.

14. The apparatus as claimed in claim 13, wherein cover is fabricated from nylon, said footing plate and said canister are fabricated from aluminum, and said helical anchor is fabricated from stainless steel.

15. An apparatus providing tamper resistant releasable retention of a memorial marker, said apparatus comprising:

a cover including an aperture located adjacent a center of said cover;

a locking mechanism attached to said cover at said center, said locking mechanism oriented vertically through said cover;

a footing plate configured to be buried below a surface of the earth, said footing plate having a width greater than said cover to provide lateral stability, said footing plate including a recessed surface aligned with said aperture, said recessed surface configured to seat an end of a post of said memorial marker to prevent torqueing of said post;

an elongated anchor connected to said plate; and a canister connecting said cover to said footing plate and providing an inner cavity within which said locking mechanism is moveable between a locked position for retention of said memorial marker and an unlocked position for release of said memorial marker.

16. The apparatus as claimed in claim 15, wherein said cover includes a peripheral groove retaining a topmost edge of said canister.

17. The apparatus as claimed in claim 16, wherein said locking mechanism includes a latch capable of horizontal movement into a notch of a post attached to said memorial marker so as to retain a portion of said post within said inner cavity between said aperture and said recess.

18. The apparatus as claimed in claim 17, wherein said elongated anchor is formed by a helical auger.

19. The apparatus as claimed in claim 18, wherein cover is fabricated from a material resistant to corrosion and sunlight.

20. The apparatus as claimed in claim 19, wherein said footing plate, said canister, and said elongated anchor are each fabricated from a suitably durable metal.

* * * * *